US008249491B2

(12) United States Patent
Hirose et al.

(10) Patent No.: US 8,249,491 B2
(45) Date of Patent: Aug. 21, 2012

(54) FIXING DEVICE AND IMAGE FORMING APPARATUS INCLUDING SAME

(75) Inventors: Fumihiro Hirose, Kanagawa (JP); Takeshi Yamamoto, Kanagawa (JP); Takashi Seto, Kanagawa (JP); Kenichi Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 11 days.

(21) Appl. No.: 12/929,563

(22) Filed: Feb. 1, 2011

(65) Prior Publication Data

US 2011/0217091 A1 Sep. 8, 2011

(30) Foreign Application Priority Data

Mar. 5, 2010 (JP) ..... 2010-049032

(51) Int. Cl.
*G03G 15/20* (2006.01)
*B65H 29/54* (2006.01)

(52) U.S. Cl. ..... 399/323; 271/309

(58) Field of Classification Search ..... 399/323, 399/398; 271/309, 307, 900, 308
See application file for complete search history.

(56) References Cited

U.S. PATENT DOCUMENTS

| | | | |
|---|---|---|---|
| 5,400,123 | A | 3/1995 | Sato et al. |
| 6,131,009 | A | 10/2000 | Hasegawa |
| 6,345,170 | B1 | 2/2002 | Nakazato et al. |
| 6,496,666 | B2 | 12/2002 | Hayashi et al. |
| 6,591,081 | B2 | 7/2003 | Hasegawa |
| 7,070,182 | B2 | 7/2006 | Hasegawa |
| 7,515,850 | B2 | 4/2009 | Hasegawa |
| 7,551,882 | B2 | 6/2009 | Seto et al. |
| 7,630,652 | B2 | 12/2009 | Hasegawa |
| 7,643,767 | B2 | 1/2010 | Seto et al. |
| 7,711,300 | B2 | 5/2010 | Nakafuji et al. |
| 7,711,301 | B2 | 5/2010 | Takemoto et al. |
| 7,790,343 | B2 | 9/2010 | Suzuki et al. |
| 7,856,201 | B2 | 12/2010 | Takagaki et al. |
| 7,869,752 | B2 | 1/2011 | Kayahara et al. |
| 2002/0009306 | A1 | 1/2002 | Hayashi et al. |
| 2002/0044805 | A1 | 4/2002 | Hasegawa |
| 2004/0178573 | A1 | 9/2004 | Hasegawa |
| 2006/0029411 | A1 | 2/2006 | Ishii et al. |
| 2006/0257183 | A1 | 11/2006 | Ehara et al. |
| 2007/0014600 | A1 | 1/2007 | Ishii et al. |

(Continued)

FOREIGN PATENT DOCUMENTS

| | | | |
|---|---|---|---|
| JP | 5573956 | U | 5/1980 |

(Continued)

*Primary Examiner* — David Gray
*Assistant Examiner* — Billy J Lactaoen
(74) *Attorney, Agent, or Firm* — Harness, Dickey & Pierce, PLC

(57) ABSTRACT

A fixing device includes a heater, a rotary fixing member, and a rotary pressing member pressing against the rotary fixing member to form a nip therebetween through which a recording medium bearing a toner image passes to fix the toner image thereon. The fixing device includes an air supply tube disposed downstream from the nip in the direction of conveyance of the recording medium and connected to an air source of an image forming apparatus, to supply compressed air to a plurality of nozzles disposed on the air supply tube along a long axis of the nip perpendicular to the direction of conveyance and inject pulsed compressed air against the recording medium passing through the nip. The air supply tube includes an exhaust opening disposed at an extreme upstream end of the flow of the compressed air outside the recording medium passing area near the air source.

4 Claims, 7 Drawing Sheets

U.S. PATENT DOCUMENTS

2007/0077104 A1 4/2007 Hasegawa
2007/0147912 A1* 6/2007 Fujii ..... 399/323
2007/0212126 A1 9/2007 Seto et al.
2007/0212129 A1 9/2007 Takemoto et al.
2007/0218386 A1 9/2007 Suzuki et al.
2008/0008505 A1 1/2008 Seto et al.
2008/0069610 A1 3/2008 Nakafuji et al.
2008/0199229 A1 8/2008 Fujita et al.
2008/0219717 A1 9/2008 Kayahara et al.
2008/0219718 A1 9/2008 Fujita et al.
2008/0310862 A1 12/2008 Hasegawa
2009/0003898 A1 1/2009 Kayahara et al.
2009/0016786 A1 1/2009 Suzuki et al.
2009/0116880 A1 5/2009 Takagaki et al.
2009/0297199 A1 12/2009 Yamashina et al.
2010/0014897 A1 1/2010 Seto et al.
2010/0014903 A1 1/2010 Seto et al.
2010/0092220 A1 4/2010 Hasegawa et al.
2010/0092221 A1 4/2010 Shinshi et al.
2010/0202809 A1 8/2010 Shinshi et al.
2010/0232844 A1 9/2010 Saito et al.
2010/0239292 A1 9/2010 Fujita et al.
2010/0290822 A1 11/2010 Hasegawa et al.
2011/0026987 A1 2/2011 Hasegawa
2011/0026988 A1 2/2011 Yoshikawa et al.
2011/0044734 A1 2/2011 Shimokawa et al.
2011/0052237 A1 3/2011 Yoshikawa et al.
2011/0052245 A1 3/2011 Shinshi et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0076071 A1 3/2011 Yamaguchi et al.
2011/0085832 A1 4/2011 Hasegawa et al.
2011/0116848 A1 5/2011 Yamaguchi et al.
2011/0176822 A1 7/2011 Ishii et al.

FOREIGN PATENT DOCUMENTS

JP 60247672 A 12/1985
JP 61059468 A 3/1986
JP 2581429 U 9/1993
JP 2004212954 A 7/2004
JP 2005049647 A 2/2005
JP 2005157179 A 6/2005
JP 2007079411 A 3/2007
JP 2007199462 A 8/2007
JP 2007206153 A 8/2007
JP 2007240920 A 9/2007

* cited by examiner

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2010-049032, filed on Mar. 5, 2010 in the Japan Patent Office, which is hereby incorporated herein by reference in its entirety.

BACKGROUND OF THE INVENTION

1. Field of the Invention

Exemplary aspects of the present invention generally relate to a fixing device and an image forming apparatus including the same, and more particularly, to a fixing device that fixes a toner image on a recording medium, and an image forming apparatus, such as a copier, a facsimile machine, a printer, or a digital multi-functional system including a combination thereof, incorporating the fixing device.

2. Description of the Background Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to make the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

The fixing device used in such image forming apparatuses may include a pair of looped belts or rollers, one being heated by a heater for melting toner (hereinafter referred to as "fixing member") and the other being pressed against the fixing member (hereinafter referred to as "pressure member"). In a fixing process, the fixing member and the pressure member meet and press against each other, forming a so-called a fixing nip through which a recording medium is passed to fix a toner image thereon under heat and pressure.

During the fixing process, the melted toner in the toner image on the recording medium contacts the fixing member. In order to facilitate clean separation of the recording medium from the fixing member after the fixing process, the fixing member is often coated with fluorocarbon resin, and a separation pawl disposed downstream from the fixing nip is used to separate the recording medium physically from the fixing member.

Disadvantageously, however, the known separation pawl contacts the fixing member, and consequently, the separation pawl may damage the surface of the fixing member. When this happens, an output image has undesirable streaks appearing therein.

To address such a problem, a generally-known monochrome image forming apparatus employs a fixing member made of metal roller coated with Teflon (registered trademark). In this configuration, the fixing roller is prevented from getting easily damaged even when the separation pawl contacts the fixing member, thereby enhancing durability.

By contrast, in a case of a color image forming apparatus, the fixing member has a surface layer made of silicone rubber (generally, a PFA tube with a thickness of some tens of microns is used) coated with fluoride, or applied with oil to enhance color development. In this configuration, the surface layer is relatively soft and hence can be damaged easily by the separation pawl. Accordingly, color image forming apparatuses in recent years rarely employ such a separation pawl that directly contacts the fixing member to separate the recording medium therefrom, but instead employ a so-called contactless separation method.

One such contact-less separation method includes injecting compressed air from nozzles against the end of the fixing nip to separate the leading end of the recording medium from the fixing member without damaging the surface of the fixing member.

Although advantageous, this approach has a drawback in that, because a recording medium bearing a solid image or a photo-image, or having a small margin tends to contain moisture, the recording medium sticks easily to the fixing member. Such a recording medium is difficult to separate from the fixing member unless the injected air acts directly on the recording medium.

In order to facilitate an understanding of the related art and of the novel features of the present invention, with reference to FIGS. 8 through 12, a description is provided of a related-art contactless separation method using an air separation mechanism. FIG. 8 is a schematic diagram illustrating a fixing device employing a related-art air separation mechanism. FIG. 9 is a schematic diagram illustrating separation of the recording medium using the related-art air separation mechanism illustrated in FIG. 8. FIG. 10 is a schematic diagram illustrating separation of the recording medium using the related-art air separation mechanism when the recording medium is conveyed while sticking to the fixing member. FIG. 11 is a plan view illustrating the related-art air separation mechanism. FIG. 12 is a graph showing a relation of a distance between an air supply source and a pressure at the tip of the nozzle (nozzle pressure).

As illustrated in FIG. 8, the related-art air separation mechanism includes an air supply tube 90 (shown in FIG. 11) and nozzles 87 that inject compressed air against a recording medium P discharging from the fixing nip between a pressure roller 81 and a fixing roller 82 to prevent the recording medium from sticking to the fixing roller 82 as the recording medium is discharged from the fixing nip as illustrated in FIG. 9.

Disadvantageously, however, the recording medium, which can be separated reliably from the fixing roller 82 as illustrated in FIG. 9, is limited to a relatively high basis-weight recording medium having a small amount of unfixed toner and hence less moisture. On the other hand, when discharging a relatively light basis-weight recording medium bearing a large amount of unfixed toner and moisture from the fixing nip, if the air is not injected against the leading end of the recording medium evenly in a longitudinal direction, the portion of the recording medium not exposed to air injection remains stuck to the fixing roller 82 as illustrated in FIG. 10. When this happens, the recording medium adhering to the fixing roller 82 keeps on being conveyed, and continues to apply heat to the recording medium unevenly. As a result, the unfixed toner on the recording medium is fixed unevenly in the longitudinal direction, causing an image defect.

In order to separate the recording medium from the fixing roller reliably, one conceivable solution may include increasing a number of nozzles along the longitudinal direction of the fixing roller so that the air is injected across the leading end of the recording medium in the longitudinal direction. However, in a configuration in which a plurality of nozzles, for example, at least 15 nozzles, are disposed on a air supply tube 90 as illustrated in FIG. 11, an amount of air pressure varies from nozzle to nozzle depending on the distance of the nozzle from the air supply source.

With reference to FIG. 12, a description is provided of the relation between distance from the air supply source to the nozzles and the air pressure of nozzles, based on a simulation performed by the present inventors. In FIG. 12, a double-headed arrow represents a recording medium passing area over which a recording medium passes.

In the air supply tube 90, a velocity of flow of compressed air is very fast and thus moves straight. Counterintuitively, however, the pressure of the compressed air near the nozzles near the air supply source drops because the compressed air moving in the air supply tube 90 draws the compressed air near the nozzles substantially near the air supply source, thereby reducing the pressure. As a result, the compressed air is not supplied sufficiently to the nozzles near the air supply source compared with the nozzles far from the air supply source. By contrast, the velocity of flow of the compressed air decreases near the nozzles far from the air supply source and a linearity of air flow is reduced. Accordingly, the compressed air is supplied to the nozzles smoothly.

In this configuration, the compressed air is not projected evenly from the plurality of nozzles, and hence the recording medium is not separated reliably from the fixing device.

SUMMARY OF THE INVENTION

In view of the foregoing, in one illustrative embodiment of the present invention, a fixing device includes a heater, a fixing member, a rotary pressing member, a recording medium passing area, an air supply tube, a plurality of nozzles, and an exhaust opening. The fixing member is formed in a loop to rotate in a predetermined direction and fixes a toner image on a recording medium by heating and fusing the toner image. The rotary pressing member is disposed opposite the fixing member to press against the fixing member to form a nip between the fixing member and the pressing member through which the recording medium bearing the toner image passes. The recording medium passing area defined on the fixing member and through which the recording medium is conveyed, has a width extending in a direction perpendicular to a direction of conveyance of the recording medium. The air supply tube is disposed downstream from the nip in the direction of conveyance of the recording medium and connected to an air source of an image forming apparatus, to supply compressed air. The plurality of nozzles diverging from the air supply tube along a long axis direction of the nip perpendicular to the direction of conveyance the recording medium injects compressed air against the recording medium passing through the nip. The exhaust opening in the air supply tube is disposed outside the recording medium passing area at an extreme upstream end in the direction of the flow of compressed air near the air source before the nozzles.

In another illustrative embodiment of the present invention, an image forming apparatus includes an image carrier, a developing device, a transfer device, and a fixing device. The image carrier bears an electrostatic latent image on a surface thereof. The developing device develops the electrostatic latent image formed on the image bearing member using toner to form a toner image. The transfer device transfers the toner image onto the recording medium. The fixing device fixes the toner image on the recording medium. The fixing device includes a heater, a fixing member, a rotary pressing member, a recording medium passing area, an air supply tube, a plurality of nozzles, and an exhaust opening. The fixing member is formed in a loop to rotate in a predetermined direction and fixes a toner image on a recording medium by heating and fusing the toner image. The rotary pressing member is disposed opposite the fixing member to press against the fixing member to form a nip between the fixing member and the pressing member through which the recording medium bearing the toner image passes. The recording medium passing area defined on the fixing member and through which the recording medium is conveyed, has a width extending in a direction perpendicular to a direction of conveyance of the recording medium. The air supply tube is disposed downstream from the nip in the direction of conveyance of the recording medium and connected to an air source of an image forming apparatus, to supply compressed air. The plurality of nozzles diverging from the air supply tube along a long axis direction of the nip perpendicular to the direction of conveyance the recording medium injects compressed air against the recording medium passing through the nip. The exhaust opening in the air supply tube is disposed outside the recording medium passing area at an extreme upstream end in the direction of the flow of compressed air near the air source before the nozzles.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
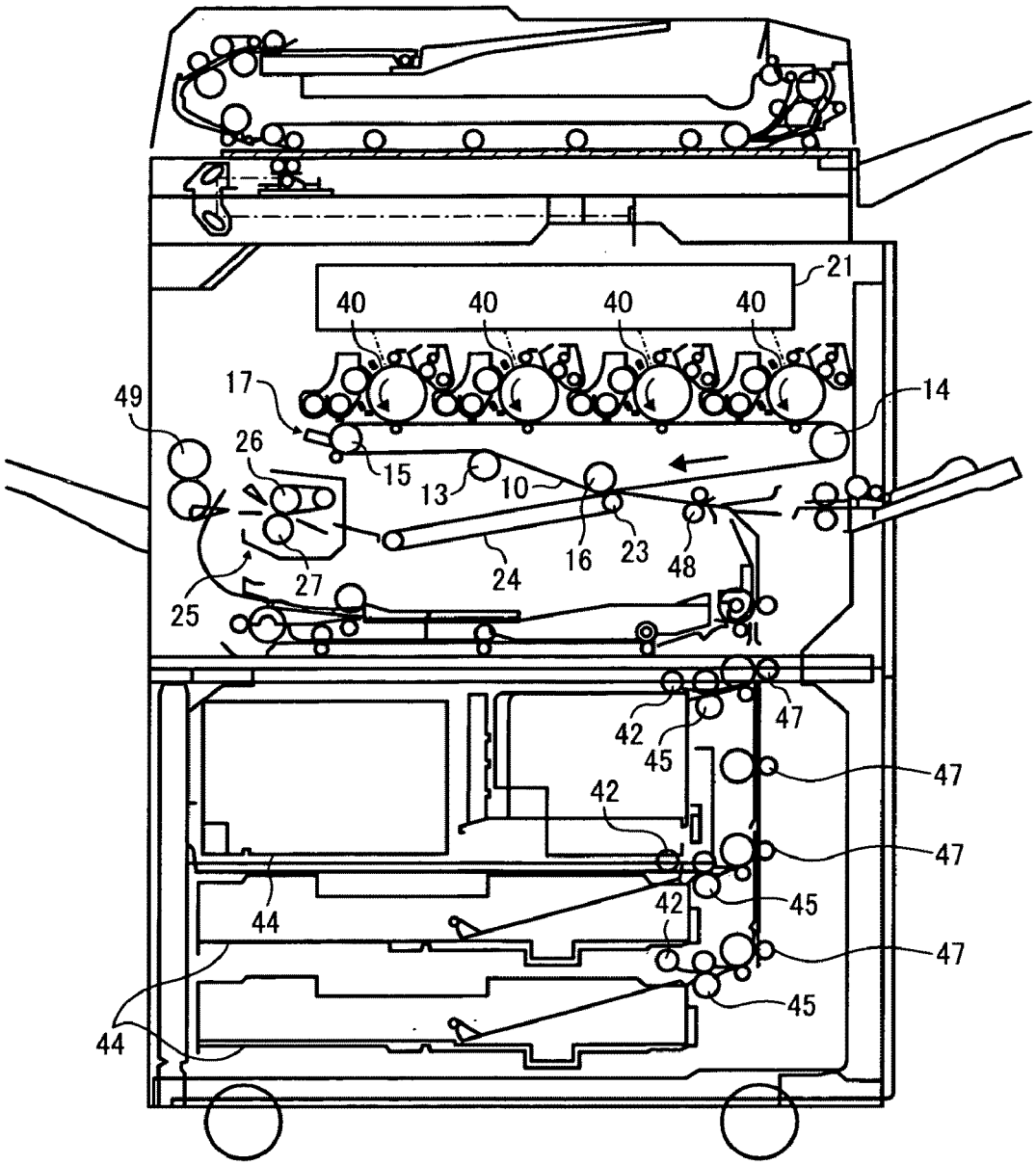
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating an image forming apparatus using a tandem-type indirect or intermediate transfer method. As illustrated in FIG. 1, the image forming apparatus includes an endless belt-type intermediate transfer member (hereinafter intermediate transfer belt) 10, a plurality of support rollers 13, 14, 15, and 16, a belt cleaner 17, four image forming units each of which including a photosensitive drum 40 serving as an image carrier, an exposure device 21, a secondary transfer roller 23, a secondary transfer belt 24, and a fixing device 25 including a fixing belt 28, a fixing roller 26 and a pressure roller 27.

The intermediate transfer belt 10 is wound around and stretched between the support rollers 14, 15, and 16, and rotated clockwise indicated by an arrow in FIG. 1. On the left of the support roller 15, the belt cleaner 17 is disposed to remove toner remaining on the intermediate transfer belt 10 after a transfer process.

The toner recovered by the belt cleaner 17 is transported to a distal end of the image forming apparatus by a toner transporter. Subsequently, the recovered toner is dropped into a toner recovery bottle by the self-weight of the toner. A toner detector is provided to the toner recovery bottle to detect an amount of recovered toner. When the toner detects that the toner recovery bottle is full, the image forming operation is temporarily stopped to prevent the recovered toner from overflowing from the bottle.

Substantially above the intermediate transfer belt 10, four image forming units corresponding to colors black, magenta, cyan, and yellow are disposed in tandem in the direction of movement of the intermediate transfer belt 10. The exposure device 21 is disposed in an upper portion of the image forming apparatus.

The secondary transfer roller 23 is disposed opposite the support roller 16 which is disposed substantially at the bottom center inside a loop formed by the intermediate transfer belt 10.

The fixing device 25 is disposed downstream from a secondary transfer unit equipped with the secondary transfer roller 23 in a conveyance direction of the recording medium. The fixing device 25 includes the pressure roller 27 pressed against the fixing roller 26 through the fixing belt 28 serving as a fixing member, thereby defining a fixing nip between the fixing belt 28 and the pressure roller 27, through which the recording medium passes. Heat and pressure are applied to the recording medium conveyed to the fixing nip, thereby fixing an unfixed toner image on the recording medium.

When a start button of the image forming apparatus is pressed, a drive motor drives one of the support rollers 14, 15, 16 to enable other support rollers including the support roller 13 to rotate, thereby causing the intermediate transfer belt 10 to move in the clockwise direction in FIG. 1. Simultaneously, in each of the image forming units, developing devices form toner images of black, magenta, cyan, and yellow on each respective photosensitive drum 40 with toners while the photosensitive drums 40 are rotated. Along with the movement of the intermediate transfer belt 10, the toner images of black, magenta, cyan, and yellow are sequentially and overlappingly transferred onto the intermediate transfer belt 10, thereby forming a composite color image.

In a sheet feeding process, when the start button of the image forming apparatus is pressed, one of sheet feed rollers 42 in the sheet feeding unit in a lower portion of the image forming apparatus is selected to rotate so that an uppermost recording medium stored in one of sheet cassettes 44 is conveyed along a sheet path towards a roller nip formed between a pair of rollers of registration roller pair 48.

The registration roller pair 48 stops temporarily the recording medium being conveyed in the roller nip defined by the registration roller pair 48. The registration roller pair 48 resumes its rotation in appropriate timing such that the recording medium is aligned with the composite color toner image formed on the intermediate transfer belt 10. The recording medium is sent to a secondary transfer nip defined by the intermediate transfer belt 10 and the secondary transfer roller 23. In the secondary transfer nip, the composite toner image on the intermediate transfer belt 10 is transferred onto the recording medium by the secondary transfer roller 23, forming a color image on the recording medium.

After the image transfer process, the recording medium is conveyed onto the secondary transfer belt 24 and then to the fixing device 25. In the fixing device 25, heat and pressure are applied to the recording medium bearing the color image so that the color image is fixed onto the recording medium. After that, a discharge roller pair 49 discharges the recording medium outside the recording medium, that is, a stack tray.

After the image transfer process, the belt cleaner 17 cleans the residual toner that has not been transferred and thus remains on the intermediate transfer belt 10 in preparation for the subsequent imaging cycle.

Figure 2:
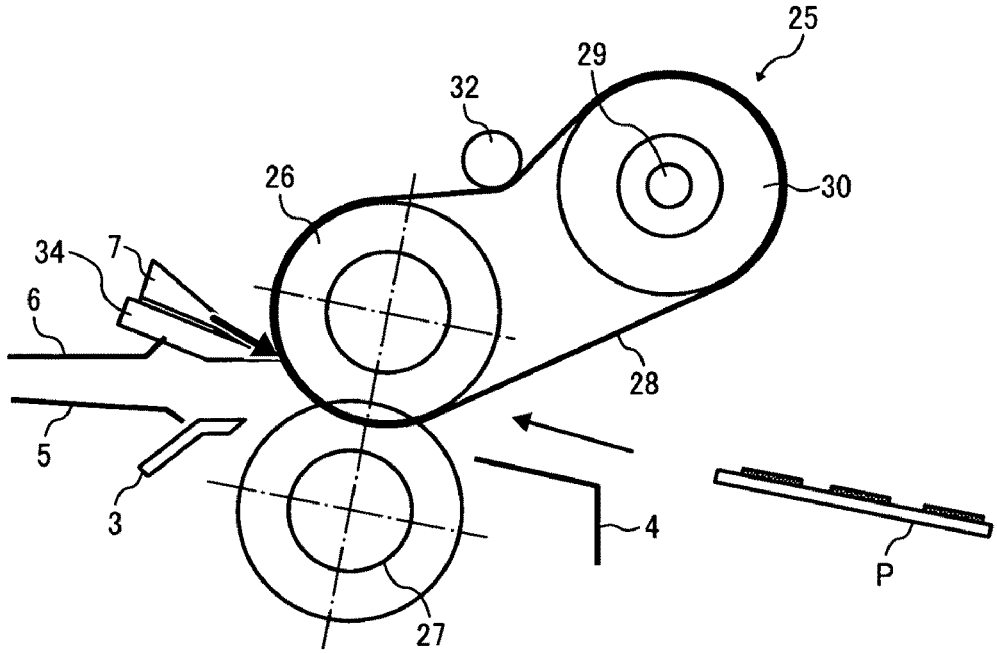
FIG. 2 is a schematic diagram illustrating a fixing device including an air separator, employed in the image forming apparatus of FIG. 1.

Referring now to FIG. 2, a description is provided of the fixing device 25 according to the illustrative embodiment. FIG. 2 is a schematic diagram illustrating the fixing device 25. The fixing device 25 is a belt-type fixing device using a fixing belt. The fixing device 25 includes the fixing belt 28 serving as a fixing member, the fixing roller 26, the pressure roller 27, a tension roller 32, and a heating roller 30 including a heater 29 inside the heating roller 30. The fixing belt 28 is wound around and stretched between the fixing roller 26 and the heating roller 30. The fixing roller 26 is a driving roller driven by a drive mechanism. Rotation of the fixing roller 26 enables the heating roller 30, which is a driven roller, to rotate. Accordingly, the fixing belt 28 rotates.

The fixing belt 28 is heated by the heating roller 30 which is heated by the heater 29. The pressure roller 27 is disposed opposite the fixing roller 26 through the fixing belt 28 and presses against the fixing roller 26. The tension roller 32 may increase an extent of contact of the fixing belt 28 relative to the heating roller 30, thereby enhancing transmission of heat from the heating roller 30 to the fixing belt 28.

The fixing belt 28 is driven by the fixing roller 26 driven by the drive mechanism. Alternatively, the pressure roller 27 may be driven by the drive mechanism.

The temperature of the surface of the fixing belt 28 is detected by a temperature detector. Based on the detection result provided by the temperature detector, the heater 29 is adjusted to heat the fixing belt 28 to a desired surface temperature of the fixing belt 28.

As the recording medium P bearing an unfixed toner image is conveyed to the fixing device 25, the recording medium P passes through the fixing nip between the fixing belt 28 and the pressure roller 27, melting the toner of the toner image. The toner image is fixed onto the recording medium P and discharged onto the stack tray outside the image forming apparatus.

The fixing device 25 according to the illustrative embodiment includes an air separator including nozzles 7 to inject compressed air into the fixing nip (only one of which is shown in the drawing), a first guide 4, second guides 5 and 6, a first separation plate 34 for separation and conveyance of the recording medium, a second separation plate 3, a cleaner, and an oil applicator.

In the fixing device 25, the first guide 4 is disposed upstream from the fixing nip in the direction of conveyance of the recording medium. The second guides 5 and 6 are disposed at the top and the bottom facing each other near end of the fixing nip. The second separation plate 3 is provided to the pressure roller 27.

Figure 3:
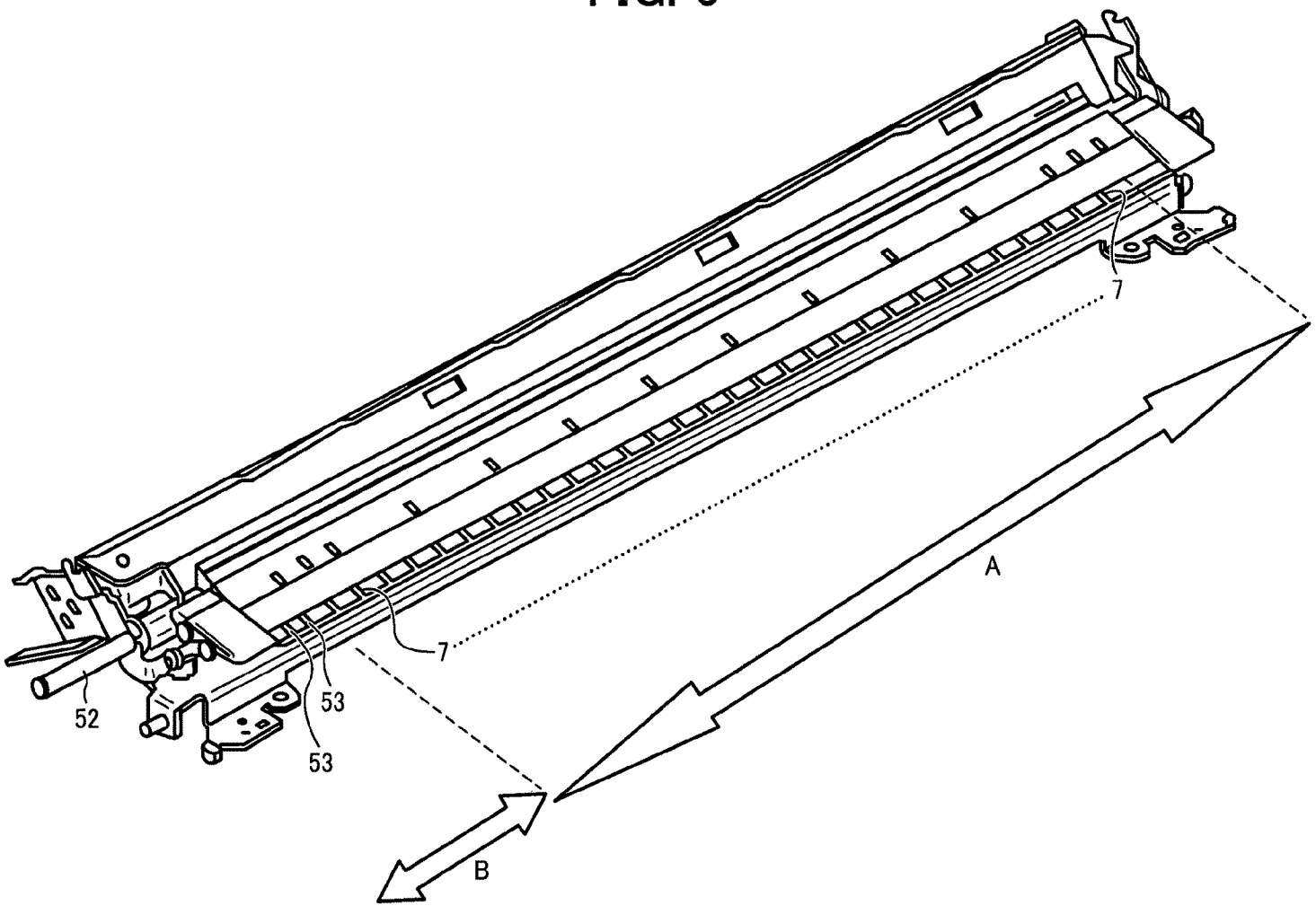
FIG. 3 is a schematic perspective view of the air/separator of FIG. 2.
Figure 4:
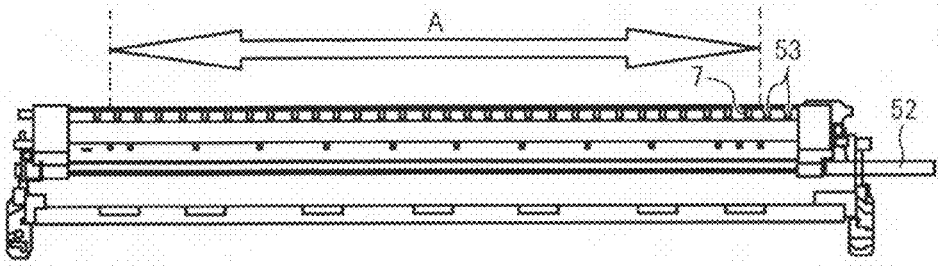
FIG. 4 is a schematic plan view of the air separator.

The nozzles 7 are disposed next to the first separation plate 34. The nozzles 7 and the first separation plate 34 may be constituted as a single integrated member. As illustrated in FIGS. 3 and 4, in the present embodiment a total of 30 nozzles are disposed along a recording medium passing area indicated by an arrow A, having a width perpendicular to the direction of conveyance of the recording medium. A double-headed arrow B indicates a non-recording medium passing area. FIG. 3 is a schematic perspective view illustrating the air separator according to the illustrative embodiment. FIG. 4 is a plan view of the air separator of FIG. 3.

Compressed air is supplied from an air supply source to the nozzles 7 through a common air supply tube 52.

The first separation plate 34 has a width wider than the width of the recording medium passing area A.

Figure 5:
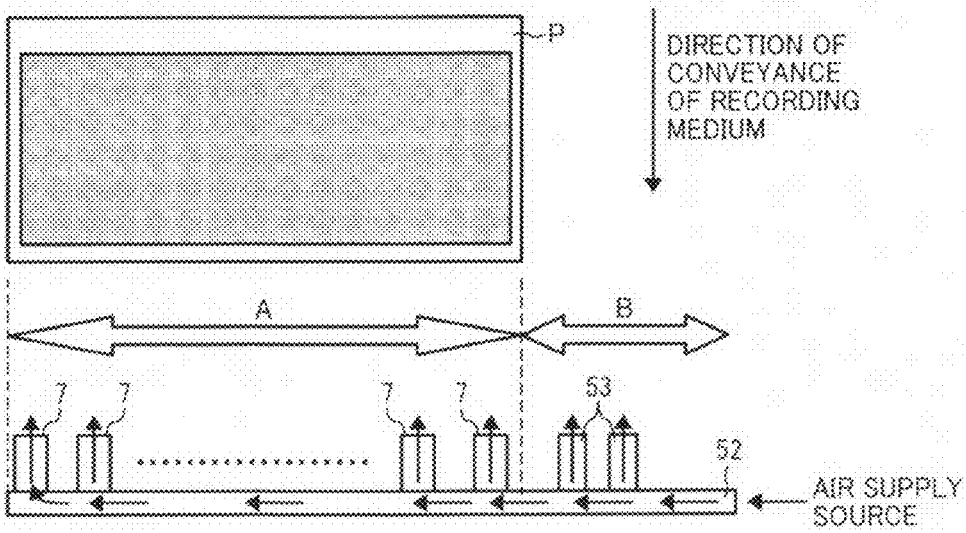
FIG. 5 is a schematic plan view of nozzles and exhaust openings disposed on an air supply tube according to an illustrative embodiment of the present invention.

With reference to FIG. 5, a description is provided of positions of the plurality of nozzles 7 relative to the air supply tube 52. FIG. 5 is a plan view illustrating the nozzles 7 and the air supply tube 52.

As illustrated in FIG. 5, exhaust openings 53 are disposed in a non-recording medium passing area B located outside the recording medium passing area A, substantially near the air supply source before the compressed air is supplied to the nozzles 7. In other words, the exhaust openings 53 are disposed at the extreme upstream end in the direction of the flow of the compressed air in the air supply tube 52. The exhaust openings 53 and the nozzles 7 are disposed such that the exhaust opening 53 and the nozzles 7 diverge from the air supply tube 52.

Figure 12:
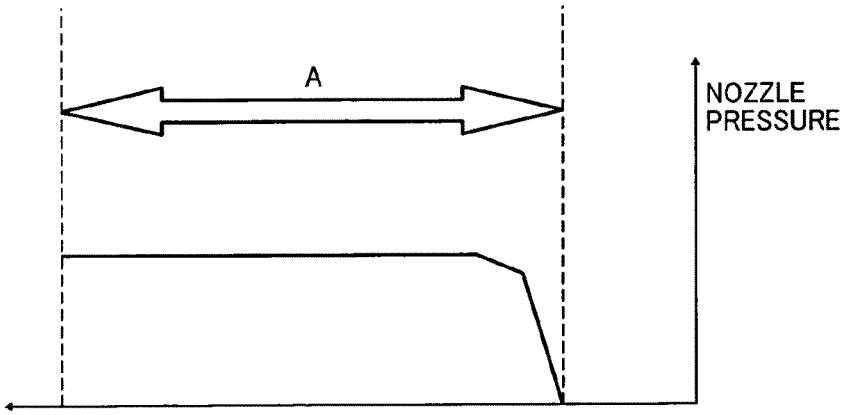
FIG. 12 RELATED ART
FIG. 12 is a graph showing a relation of a distance between an air supply source and the nozzles employed in the related art air separation mechanism, and a pressure of the tip of the nozzles.

In this configuration, the exhaust openings 53 prevent creation of a pressure gradient in the plurality of nozzles. Because the exhaust openings 53 are disposed at the extreme upstream end in the direction of the flow of the compressed air in the air supply tube 52, near the air supply source, a nozzle pressure in the vicinity of the air supply source is prevented from dropping significantly as seen in the related-art air separation mechanism as illustrated in FIG. 12. Accordingly, an amount of air injected from the nozzles near the air supply source against the sheet separation position and an amount of air injected from the nozzles substantially at a distal end portion farther from the air supply source do not vary, thereby injecting compressed air at an even pressure from the plurality of nozzles 7 disposed in the width direction of the recording medium passing area A perpendicular to the conveyance direction of the recording medium. Hence, the recording medium is separated from the fixing member without partially sticking to the fixing member.

The diameter of a tip of the nozzle, its shape, the position, and the number of nozzles may be determined based on a sheet separation testing as described below and image quality. For example, simulations of the compressed air injected from the nozzles illustrated in FIGS. 12 and 6 were performed under the following conditions:

Diameter of the tip of nozzles: 0.9 mm

Number of nozzles: 33

Distance between adjacent nozzles: 10 mm

Pressure in an air supply tank: Approximately 105 kPa.

Figure 6:
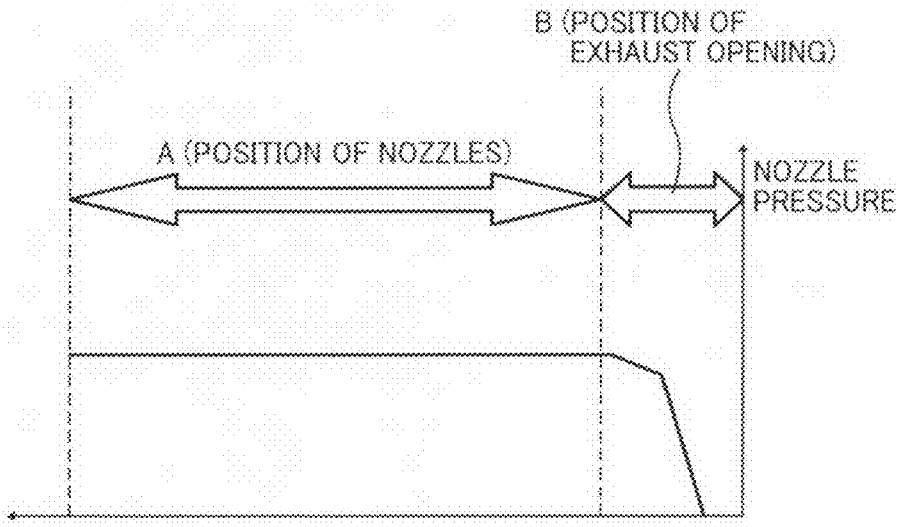
FIG. 6 is a graph showing a relation of a distance between an air supply source and the nozzles, and a pressure of the tip of the nozzles.

In FIG. 6, a double-headed arrow A represents a recording medium passing area where the nozzles are disposed. A double-headed arrow B represents a non-recording medium passing area where the exhaust openings are deposed. It was assumed that the pressure at the tip of the nozzles from which the compressed air was injected against a recording medium when separating the recording medium from the fixing belt was 10±1 kPa.

The diameter of an opening of the exhaust openings 53, the shape, the position, and the number of exhaust openings may depend on the configuration of the nozzle 7.

The air separator according to the illustrative embodiment separates a recording medium having a substantially light basis-weight (g/m$^2$) bearing a toner image having a significant amount of unfixed toner. Although such a recording medium contains moisture and hence remains stuck to the fixing member, the air separator of the present invention successfully separates the recording medium from the fixing member.

By contrast, generally, when separating a recording medium having a high basis-weight from the fixing member, it is not necessary to inject compressed air against the recording medium. In other words, the first separation plate 34 can separate the recording medium having a high basis-weight from the fixing belt or the fixing roller without the compressed air.

According to the illustrative embodiment, a clearance between the fixing belt 28 and the first separation plate 34 is approximately 0.6 mm to 1.0 mm. If the clearance is small, the first separation plate 34 separates the recording medium from the fixing belt more easily. However, based on a flow simulation performed by the present inventors, if the nozzles 7 are disposed too close to the fixing belt 28, the curved portion of the fixing belt 28 hinders the flow of compressed air injected from the nozzles 7. As a result, the compressed air cannot be supplied sufficiently to the recording medium, thus reducing effects of injection of the compressed air and resulting in poor separation of the recording medium from the fixing belt 28.

Figure 7:
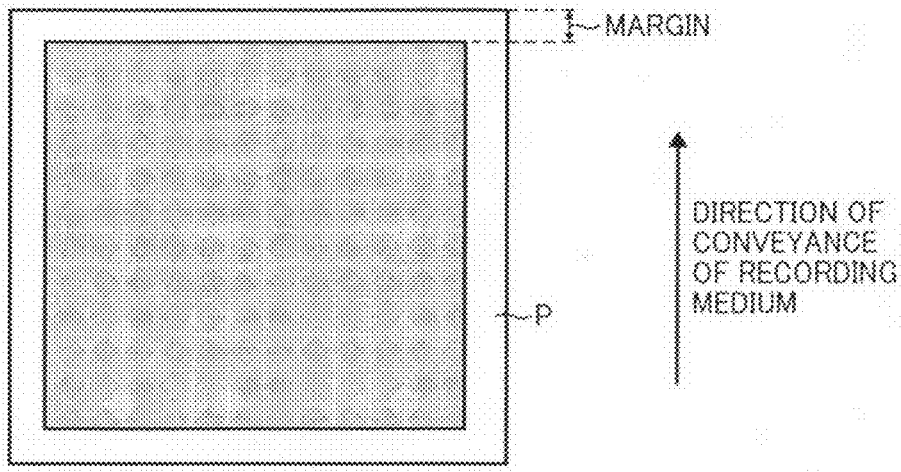
FIG. 7 is a schematic diagram illustrating an example of a recording medium with a small margin.
Figure 8:
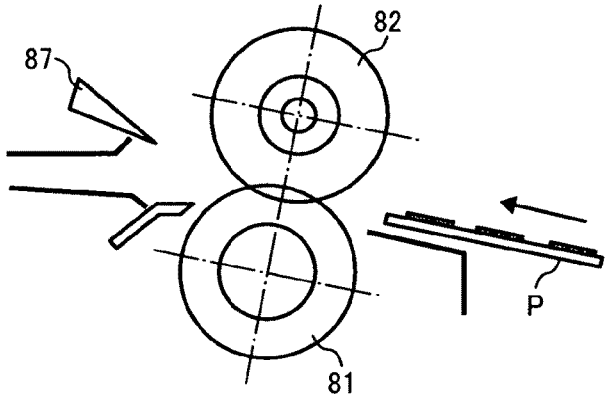
FIG. 8 RELATED ART
FIG. 8 is a schematic diagram illustrating a fixing device employing a related-art air separation mechanism.
Figure 9:
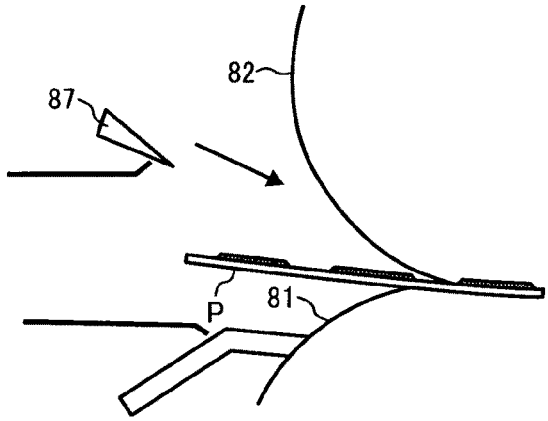
FIG. 9 RELATED ART
FIG. 9 is a schematic diagram illustrating separation of the recording medium using the related-art air separation mechanism illustrated in FIG. 8.
Figure 10:
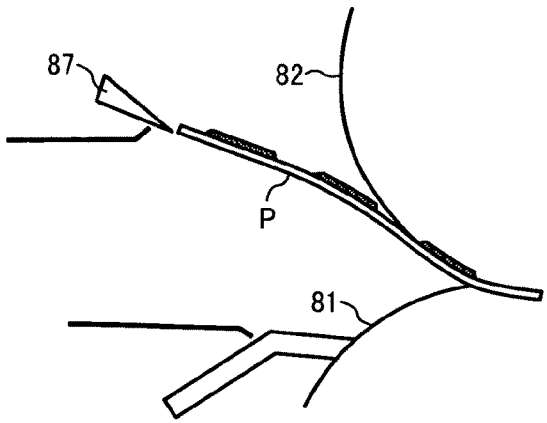
FIG. 10 RELATED ART
FIG. 10 is a schematic diagram illustrating separation of the recording medium using the related-art air separation mechanism when the recording medium is conveyed while sticking to a fixing member of the fixing device.
Figure 11:
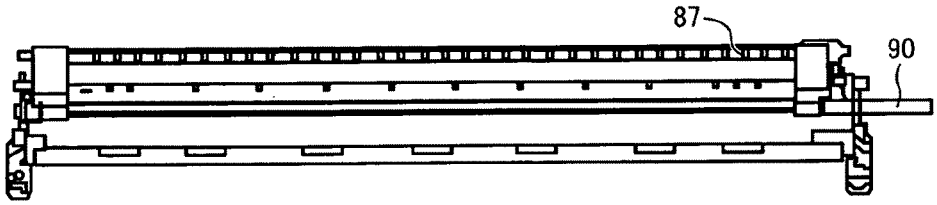
FIG. 11 RELATED ART
FIG. 11 is a schematic plan view illustrating the related-art air separation mechanism illustrated in FIG. 8.

In light of the above, the clearance between the fixing belt 28 and the first separation plate 34 is in a range from approximately 0.6 mm to 1.0 mm, to prevent the curvature of the fixing belt 28 from hindering the flow of compressed air. With this configuration, even when the recording medium having a basis-weight no more than 60 g/m$^2$ bears a significant amount of unfixed toner and has a small margin at the top of the recording medium as illustrated in FIG. 7, the recording medium P separates from the fixing belt 28. FIG. 7 is a schematic diagram illustrating an example of the recording medium with a small margin.

It is to be noted that the number of the exhaust openings 53 is not limited to one. A plurality of exhaust openings 53 may be provided.

According to the illustrative embodiment, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device, comprising:

a heater;

a fixing member formed in a loop, to rotate in a predetermined direction and fix a toner image on a recording medium by heating and fusing the toner image;

a rotary pressing member disposed opposite the fixing member, to press against the fixing member to form a nip between the fixing member and the pressing member through which the recording medium bearing the toner image passes;

a recording medium passing area defined on the fixing member and through which the recording medium is conveyed, having a width extending in a direction perpendicular to a direction of conveyance of the recording medium;

an air supply tube disposed downstream from the nip in the direction of conveyance of the recording medium and connected to an air source of an image forming apparatus, to supply compressed air;

a plurality of nozzles diverging from the air supply tube along a long axis direction of the nip perpendicular to the direction of conveyance the recording medium, to inject compressed air against the recording medium passing through the nip; and an exhaust opening in the air supply tube, disposed outside the recording medium passing area at an extreme upstream end in the direction of the flow of compressed air near the air source before the nozzles.

2. The fixing device according to claim 1, wherein the air supply tube includes at least 20 nozzles disposed within the recording medium passing area perpendicular to the direction of conveyance of the recording medium.

3. The fixing device according to claim 1, further comprising a plurality of exhaust opening.

4. An image forming apparatus comprising:

an image carrier to bear an electrostatic latent image on a surface thereof;

a developing device configured to develop the electrostatic latent image formed on the image bearing member using toner to form a toner image;

a transfer device configured to transfer the toner image onto the recording medium; and a fixing device to fix the toner image on the recording medium, the fixing device including a heater;

a fixing member formed in a loop, to rotate in a predetermined direction and fix a toner image on a recording medium by heating and fusing the toner image;

a rotary pressing member disposed opposite the fixing member, to press against the fixing member to form a nip between the fixing member and the pressing member through which the recording medium bearing the toner image passes;

a recording medium passing area defined on the fixing member and through which the recording medium is conveyed, having a width extending in a direction perpendicular to a direction of conveyance of the recording medium;

an air supply tube disposed downstream from the nip in the direction of conveyance of the recording medium and connected to an air source of the image forming apparatus, to supply compressed air;

a plurality of nozzles diverging from the air supply tube along a long axis direction of the nip perpendicular to the direction of conveyance the recording medium, to inject compressed air against the recording medium passing through the nip; and an exhaust opening disposed outside the recording medium passing area, at an extreme upstream end in the direction of the flow of compressed air near the air source before the nozzles.

* * * * *